US005339144A

United States Patent [19]

Nakai et al.

[11] Patent Number: 5,339,144

[45] Date of Patent: Aug. 16, 1994

[54] RECORDING PAPER SEPARATING DEVICE WITH CONSTANT CURRENT CONTROL

[75] Inventors: Yukio Nakai, Nara; Hiroshi Kida, Yamatokoriyama; Masashi Hirai, Ikoma; Masahiko Fujita, Soraku; Takahiro Fukunaga, Sakurai, all of Japan

[73] Assignee: Sharp Kabushiki Kaisha, Osaka, Japan

[21] Appl. No.: 751,195

[22] Filed: Aug. 29, 1991

[30] Foreign Application Priority Data

Aug. 31, 1990 [JP] Japan ..... 2-232176
Feb. 8, 1991 [JP] Japan ..... 3-018008

[51] Int. Cl.[5] ..... G03G 15/16
[52] U.S. Cl. ..... 355/274; 361/214
[58] Field of Search ..... 355/271, 274, 219, 221, 355/223, 224, 227; 361/214

[56] References Cited

U.S. PATENT DOCUMENTS

| | | | |
|---|---|---|---|
| 3,924,943 | 12/1975 | Fletcher | 355/274 |
| 4,055,380 | 10/1977 | Borostyan | 355/273 |
| 4,259,003 | 3/1981 | Mangal et al. | 355/210 |
| 4,286,862 | 9/1981 | Akita et al. | 361/235 |
| 4,341,457 | 7/1982 | Nakahata et al. | 355/274 |
| 4,739,363 | 4/1988 | Hoshika et al. | 355/274 |

FOREIGN PATENT DOCUMENTS

| | | |
|---|---|---|
| 0247602 | 12/1987 | European Pat. Off. . |
| 2946754 | 6/1980 | Fed. Rep. of Germany . |
| 63-12357 | 4/1988 | Japan . |

OTHER PUBLICATIONS

Patent Abstract of Japan, vol. 6, No. 237 (P-157)(1115) 25 Nov. 1982 & JP-A-57-135-964 (Canon K. K.) 21 Aug. 1982.

Patent Abstract of Japan, vol. 7, No. 152 (P-208)(1297) 5 Jul. 1983 & JP-A-58-062-673 (Canon K. K.) 14 Apr. 1983.

*Primary Examiner*—Leo P. Picard
*Assistant Examiner*—Christopher Horgan
*Attorney, Agent, or Firm*—David G. Conlin; Robert F. O'Connell

[57] ABSTRACT

A recording paper separating device for use in a copying machine, the device including a transfer charger for transferring a toner image from a photosensitive member onto a recording paper by discharge effected by a charging wire accommodated in a shield casing, a bias-loaded recording paper discharger, a transfer-power source, and a control for keeping a current supplied from the power source to the charging wire constant except for the current flowing through the recording paper discharger.

9 Claims, 9 Drawing Sheets

RECORDING PAPER SEPARATING DEVICE WITH CONSTANT CURRENT CONTROL

BACKGROUND OF THE INVENTION

1. Field of the Invention

The present invention relates to a device for transferring a toner image from a photosensitive means onto a recording paper, and then separating the recording paper from the photosensitive means.

2. Description of the Prior Art

In an image-forming apparatus such as electrophotographic copying machines and laser printers, an electrostatic latent image is formed on a photosensitive drum, and the latent image is developed with toner to form a toner image which is then transferred to a recording paper by a transfer charger. The recording paper bearing the toner image is separated from the photosensitive drum.

In order to explain the background, reference will be made to FIGS. 15 and 16:

The known transfer charger is disposed under a photosensitive drum 30 which is rotated in the direction of arrow A. By the time when a particular area on the photosensitive drum 30 reaches a point in opposition to the transfer charger 81, a toner image is formed thereon. The recording paper 50 is fed in the direction of arrow B between the photosensitive drum 30 and the transfer charger 81. The transfer charger 81 includes a shield casing 81*a* in which a charging wire 81*b* is provided in tension to which an electric power is supplied so as to discharge. Thus, the recording paper 50 is charged with a reverse polarity to that of the toner image. In this way the toner image on the photosensitive drum 30 is transferred onto the recording paper 50.

The recording paper 50 bearing the toner image transferred from the photosensitive drum 30 sticks to the photosensitive drum 30 and rotates together. Therefore, it is necessary to electrically separate the recording paper 50 from the photosensitive drum 30. To this end, a discharger brush unit is disposed downstream of the transfer charger 81 in the direction in which the recording paper 50 is fed.

FIG. 16 shows the discharger brush unit as an example of dischargers; the brush unit includes a number of electroconductive bristles 82 supported by an insulating support 83 in such a manner as to be spaced from one another. The tip portions of the bristles 82 are kept out of contact with the recording paper 50, and bias voltage is applied to the bristles 82; for example by connecting the bristles 82 to the ground.

The bristles 82 allow the charging wire 81*b* of the transfer charger 81 to discharge through the recording paper 50, thereby removing the charge of the recording paper 50. A feed roller 84 and a feed belt 85 are disposed downstream of the discharger brush unit in the direction in which the recording paper 50 is fed.

Other kinds of discharger can be used; for example, an electroconductive member which has a saw-toothed edge and is placed near the recording paper 50 with the saw-toothed edge toward the recording paper 50. When an electric power is supplied to the charging wire 81*b* of the transfer charger 81, an electric current flows through the photosensitive drum 30, the shield casing 81*a* of the transfer charger 81, and the discharger such as the bristles 82.

The charging wire 81*b* of the transfer charger 81 is supplied with an electric power through a constant-voltage transformer or a constant-current transformer so as to secure a constant voltage or a constant current.

However, when a constant voltage is applied to the charging wire 81*b* of the transfer charger 81 through a constant-voltage transformer, the voltage applied to the charging wire 81*b* remains consistent in spite of variations in impendance due to ambient changes. This results in the reduction of the electric charge required for transferring the toner image from the photosensitive drum 30 onto the recording paper 50. As a result, the toner image is not properly transferred from the photosensitive drum 30 onto the recording paper 50.

When the constant current is supplied to the charging wire 81*b*, the electric charge required not only for transferring the toner image but also for removing the electric charge from the bristles 82 is controlled only for maintaining a constant current. Any variations in impendance in the recording paper discharger are likely to unfavorably affect the transfer of a toner image and/or the removal of charge of the recording paper.

The discharging bristles 82 and the saw-toothed discharger are liable to deformation or damage by rough contact with a repairing tool or a cleaning tool when the copying machine is repaired or cleaned. If any deformation or damage occurs, their discharging performance is decreased. The individual bristles 82 are likely to separate from the support 83 and the separated bristles come into contact with the charging wire 81*b*, thereby causing leakage therethrough.

SUMMARY OF THE INVENTION

The recording paper separating device of this invention, which overcomes the above-discussed and numerous other disadvantages and deficiencies of the prior art, comprises a transfer charger for transferring a toner image from a photosensitive means onto a recording paper by discharge effected by a discharging wire accommodated in a shield casing, a bias-loaded recording paper discharging means, a transfer-power source, and a control for keeping a current supplied from the power source to the charging wire constant except for the current flowing through the recording paper discharging means.

In a preferred embodiment, the discharging means is made of a conductive thin plate extending perpendicular to a direction in which the recording paper is fed, and is covered with an electrically resisting material that is provided with openings spaced at intervals on the side thereof which is adjacent to the recording paper so that the discharging means is exposed through the openings.

In a preferred embodiment, the discharging means is made of a conductive thin plate extending perpendicular to a direction in which the recording paper is fed, and is provided with a plurality recesses having projections interposed therebetween, the recesses being spaced at intervals on the side of the discharging material that is adjacent to the recording paper and downstream in the paper feeding direction.

Thus, the invention described herein makes possible the objectives of (1) providing a device capable of stably transferring a toner image from a photosensitive means onto a recording paper irrespective of ambient variations, and (2) providing a device capable of separating the recording paper smoothly from the photosensitive means.

BRIEF DESCRIPTION OF THE DRAWINGS

This invention may be better understood and its numerous objects and advantages will become apparent to those skilled in the art by reference to the accompanying drawings as follows:

FIG. 6 is a perspective view showing a main portion of the prior art device of FIG. 15.

DESCRIPTION OF THE PREFERRED EMBODIMENTS

Figure 1:
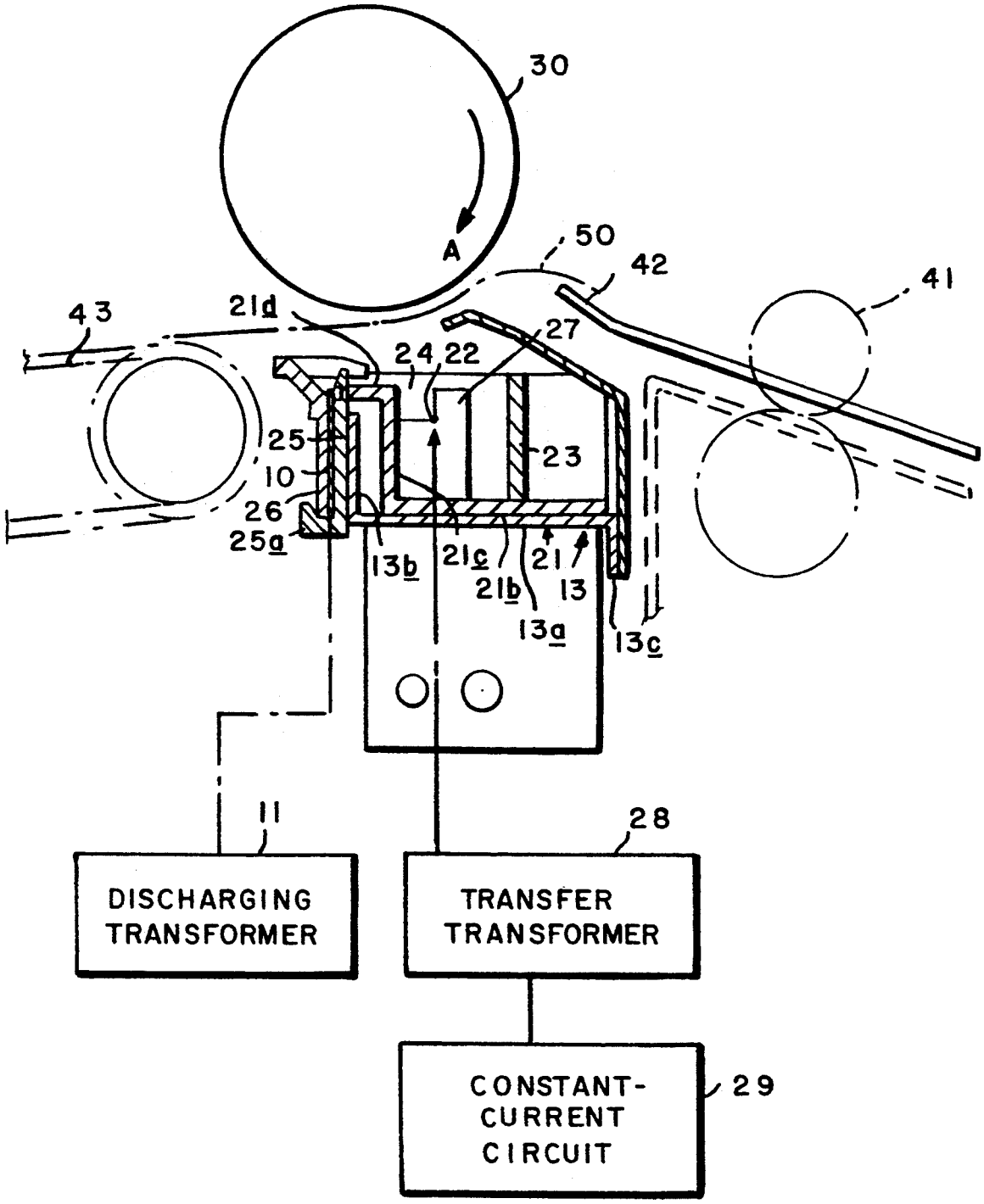
FIG. 1 is a cross-sectional view showing a recording paper separating device according to the present invention.
Figure 2:
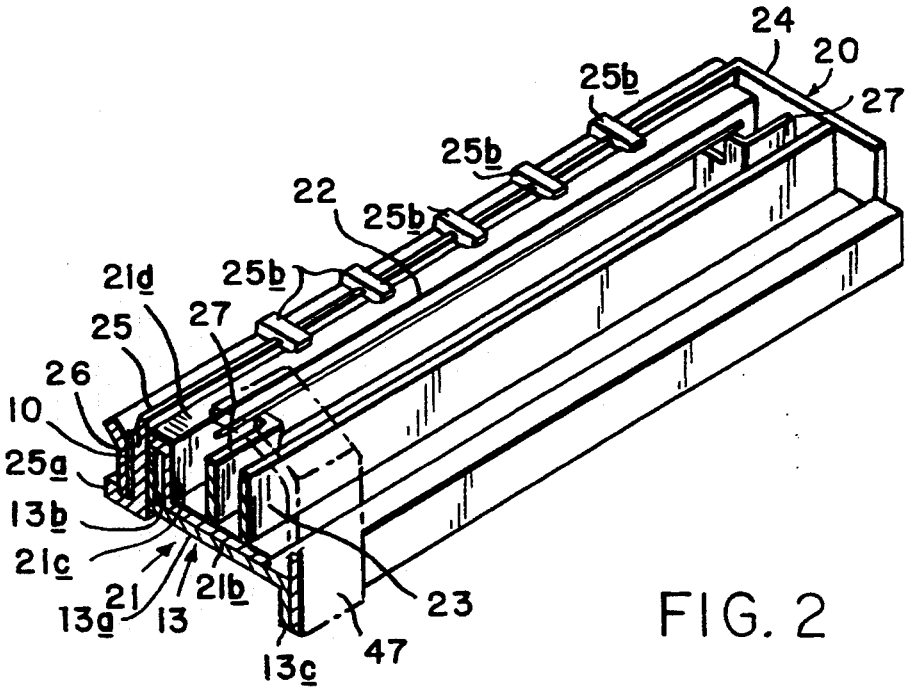
FIG. 2 is a fragmentary perspective view, partly broken, showing the device of FIG. 1.

Referring to FIGS. 1 and 2, the recording paper separating device, hereinafter called "the device", is disposed under a photosensitive drum 30, hereinafter called the "drum" which is rotated in the direction of arrow A. During the rotation of the drum 30 a toner image is formed thereon.

The toner image on the drum 30 is transferred by a transfer charger 20 (FIG. 2) onto a recording paper 50, which is fed on a guide plate 42 by a pair of rollers 41. A recording paper discharger material 10 is disposed downstream of the transfer charger 20 in the direction in which the recording paper is fed. The recording paper discharger material 10 removes the charge on the recording paper 50 which is fed to a fixing apparatus (not shown) by a conveyor belt 43.

A shield casing 21 and a charging wire 22 accommodated therein are disposed under the photosensitive drum 30. The shield casing 21 has an L-shaped cross-section, includes a bottom 21*b*, a side wall 21*c* upright at one side of the bottom 21*b*, and a flange 21*d* horizontally extending from a terminating end of the side wall 21*c* in the direction in which the recording paper is fed. The shield casing 21 also has a partition 23 upright on the bottom 21*b* spaced from the side wall 21*c* so as to accommodate the charging wire 22 therein.

The charging wire 22 is provided in tension by suitable supports 27 which are made independently of the side wall 21*c* and the bottom 21*b*. Each support 27 is joined to a side wall 24 closing the respective end openings of the shield casing 21 and a discharger retainer 25 extending along the flange 21*d* through an insulating material. The discharger retainer 25 includes a tray portion 25*a* extending in the direction in which a recording paper is fed. The discharger material 10 is retained against the discharger retainer 25 pressed by a presser 26 on the tray portion 25*a*, thereby enabling the discharger material 10 to be upright on the tray portion 25*a*.

The discharger material 10 is made of a conductive substance, and is maintained between the discharger retainer 25 and the presser 26 in such a manner as be spaced from the top portions of the discharger retainer 25 and the presser 26. Thus the upper end portion of the discharger material 10 is exposed.

The presser 26 is provided with an appropriate number of guide members 25*b* mutually spaced on the top edge of the discharger retainer 25. The guide members 25*b* are arranged axially of the photosensitive drum 30 so as to guide a recording paper. Each guide member 25*b* is prolonged in the direction in which the recording paper is fed so as to prevent the recording paper 50 from being advancing toward the exposed top end of the discharger material 10. Each guide member 25*b* is joined to the discharger retainer 25 through an insulating material. In this way the guide members 25*b* are integral with the side walls 24 of the transfer charger 20.

The shield casing 21 and the discharger retainer 25 in the transfer charger 20 are supported by a base support 13 which includes a base portion 13*a* kept in face-to-face contact with the bottom 21*b*, an upright portion 13*b* and a leg portion 13*c* which support a guide member 47 for guiding the recording paper to the photosensitive drum 30.

The charging wire 22 of the transfer charger 20 is supplied with electric power from a transfer transformer 28, and the electroconductive discharger material 10 is supplied with electric power from the discharge transformer 11 so as to apply a constant bias voltage. The current of the transfer transformer 28 is made constant through a constant-current circuit 29.

Figure 3:
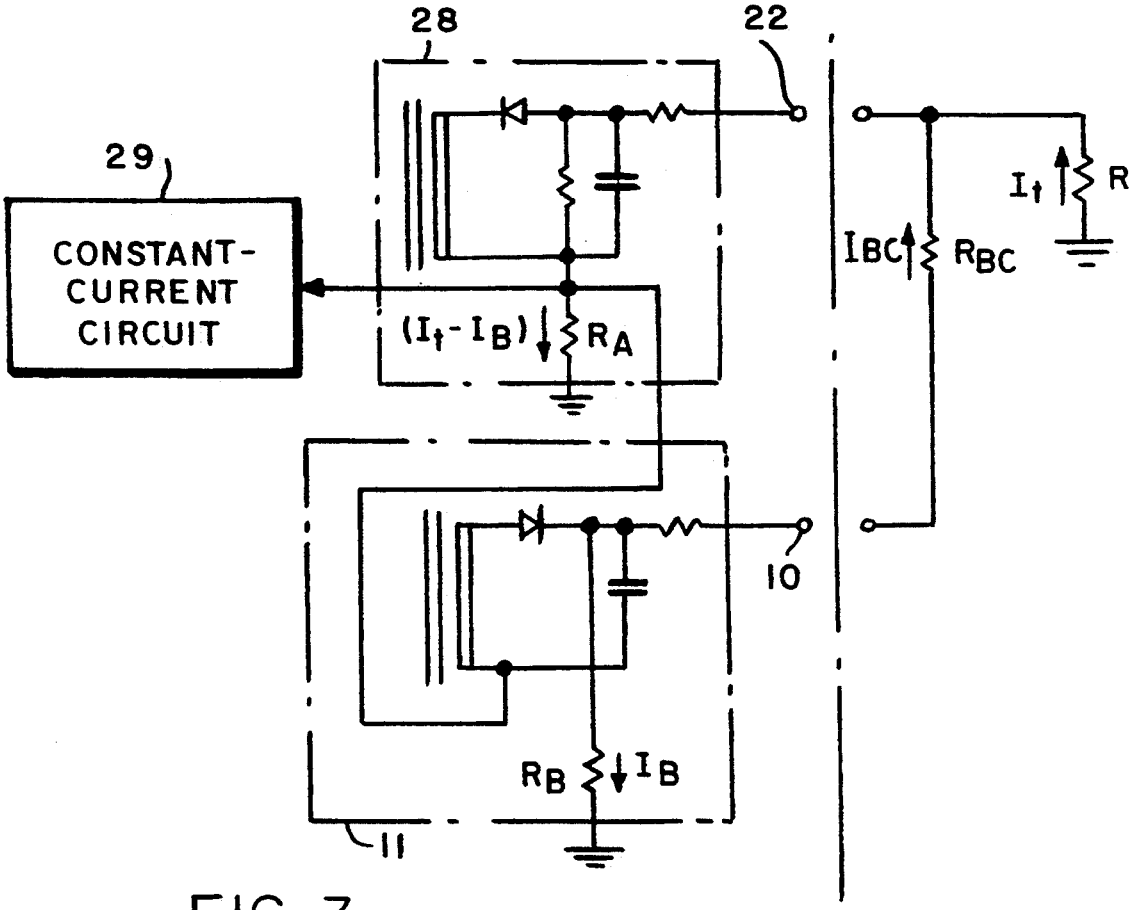
FIG. 3 is an equivalent circuit used in the device of FIG. 1.

FIG. 3 shows an equivalent circuit of the transfer transformer 28 and the discharger transformer 11. The discharge of the charging wire 22 allows a current to flow through the photosensitive drum 30 and the shield casing 21, and also flow from the recording paper 50 to the discharger material 10. In FIG. 3 an impedance occurs in the current flowing through the photosensitive drum 30 and the discharger material 10, and an impedance $R_{BC}$ occurs in the current flowing to the discharger material 10 through the recording paper 50.

FIG. 3 shows a current $I_B$ flowing through a discharge resistance $R_B$ of the discharger transformer 11. The constant-current circuit 29 makes a current $(I_t - I_B)$ constant. $Y_{BC}$ changes responsive to changes in the resistance $R_{BC}$, but a monitor resistance $R_A$ has no current flow. The current flowing from the charging wire 22 to the photosensitive drum 30 and the shield casing 21 is made constant by the constant-current circuit 29 with disregard to the current $I_{BC}$ flowing to the discharging material 10 through the recording paper 50.

The recording paper 50 is fed by a pair of feed rollers 41, under the guidance provided by a guide plate 42, wherein the feed rollers 41 are rotated synchronously with the rotation of the photosensitive drum 30 bearing a toner image so as to feed the recording paper 50 to the photosensitive drum 30. When the recording paper 50 reaches a point above the transfer charger 20, a predetermined electric power is supplied to the charging wire 22 of the transfer charger 20 from the transfer transformer 28, and a predetermined bias voltage is applied to the discharging material 10 from the discharging transformer 11.

When the charging wire 22 is supplied with the electric power, generates corona discharge, thereby enabling an electric current to flow through the photosensitive drum 30 and the shield casing 21, and through the recording paper 50 and the discharging material 10. In this way the toner image on the photosensitive drum 30 is transferred onto the recording paper 50 by the current flowing through the photosensitive drum 30 and the shield casing 21. At this time, the static electricity on the recording paper 50 is discharged through the charging wire 22 to the discharging material 10.

The electric current flowing through the photosensitive drum 30 and the shield casing 21 from the charging wire 22 is made constant at a predetermined value by the constant-current circuit 29. Because of the constant current an electric current required for toner image transfer is secured, and the toner image is transferred onto the recording paper 50.

Because of the removal of the static electricity from the discharging material 10, the recording paper 50 bearing the toner image is separated from the photosensitive drum 30, and fed by the conveyor belt 43 to the fixing device (not shown).

Figure 4:
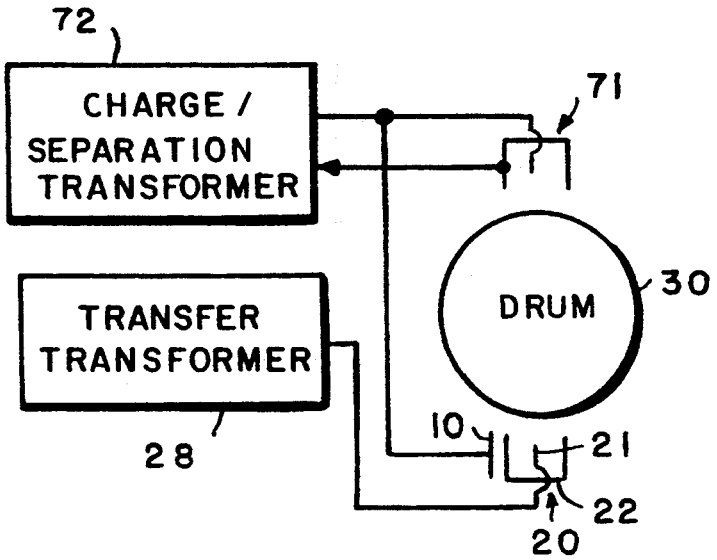
FIG. 4 is a schematic view showing a second example of the recording paper separating device.

In the illustrated embodiment, the bias voltage is applied to the discharging material 10 by the discharging transformer 11, but as shown in FIG. 4, a charge/separation transformer 72 can be used to apply a bias voltage, wherein the charge/separation transformer 72 is provided so as to supply electric power to the charging wire of a charger 71 for charging the photosensitive drum 30. In this case, it is preferable that the current flowing through the shield casing **71*b* is controlled so as to be constant by feeding back the current to the charge/separation transformer 72, thereby securing the removal of charge from the recording paper 50 constant. It is economically more advantageous to apply bias voltage to the discharging material 10 by the charge/separation transformer 72** than to from the constant-current transformer, and another advantage is that there is no need for providing a control circuit and a protection circuit against variations in the load due to ambient changes.

Referring to FIGS. 5 to 8, another example will be described:

The transfer charger 61 is shaped by bending a shield casing **61*a* of a conductive thin plate into a box, and has an opening toward the photosensitive drum 30. The shield casing 61*a* accommodates a charging wire 61*b* inserted therethrough, and the charging wire 61*b* is situated adjacent to the photosensitive drum 30 through the opening. The recording paper 50 is fed in the direction of arrow C in FIG. 5; that is, perpendicular to the charging wire 61*b***.

Figure 6:
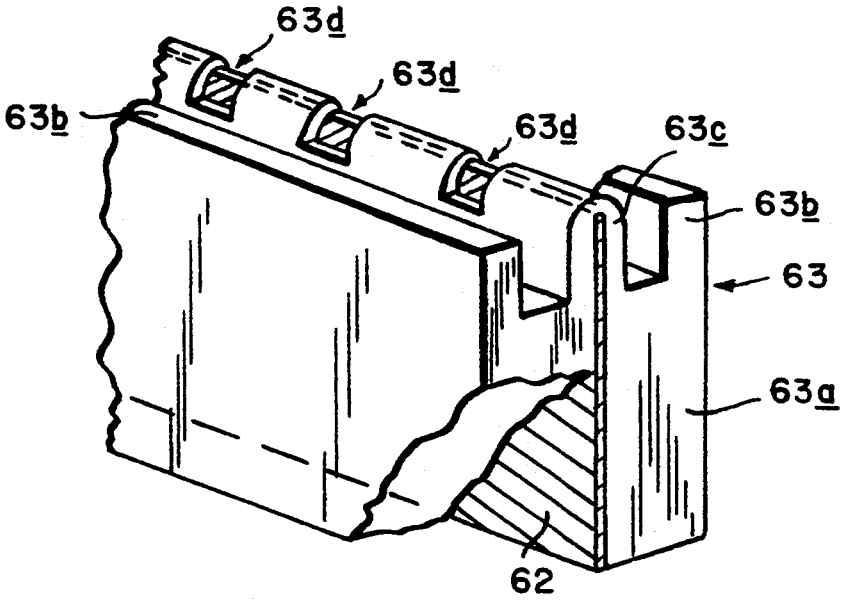
FIG. 6 is a perspective view showing a main portion of the device of FIG. 5.

Referring to FIG. 6, the recording paper discharging material 62 is made of a conductive thin plate, such as 0.05 to 0.2 mm thick, and is retained by a retainer 63 in such a position as to be perpendicular to the direction in which the recording paper 50 is fed. The retainer 63 is made of a highly resistant material, and includes a main body **63*a* in which the discharging material 62 is embedded except for its top portion, a pair of side edges 63*b* extending in the direction of length, and a central projecting wall 63*c* covering the embedded discharging material 62. The central projecting wall 63*c* includes slits 63*d* spaced at appropriate intervals so as to allow the discharging material 62** to be exposed outside.

Figure 7:
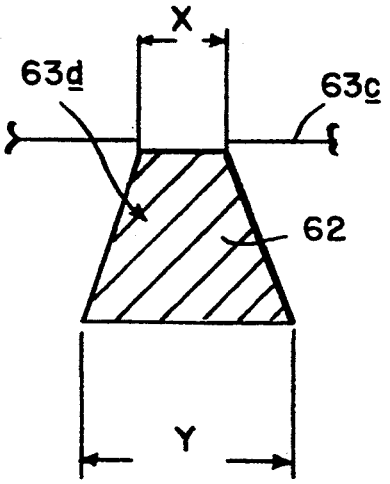
FIG. 7 is a schematic view on an enlarged scale showing a main portion of the device of FIG. 5.

Each exposed discharging material 62 takes the shape of a trapezoid as shown in FIG. 7, having a bottom line Y longer than an upper side. This shape is effective to remove the charge from the recording paper 50.

Since the discharging material 62 is protected by the main body **63*a* from becoming damaged by external force accidentally applied thereto, except for the exposed slits 63*d*. When a discharging brush is used, the brush hairs are likely to fall during use, and keep contact with the charging wire, thereby causing a leakage. However, the discharging material 62 avoids the occurrence of leakage. In addition, the discharging material is largely covered by the main body 63*a***, thereby eliminating the risk of injury, for example, cutting a finger with a sharp edge.

Figure 8:
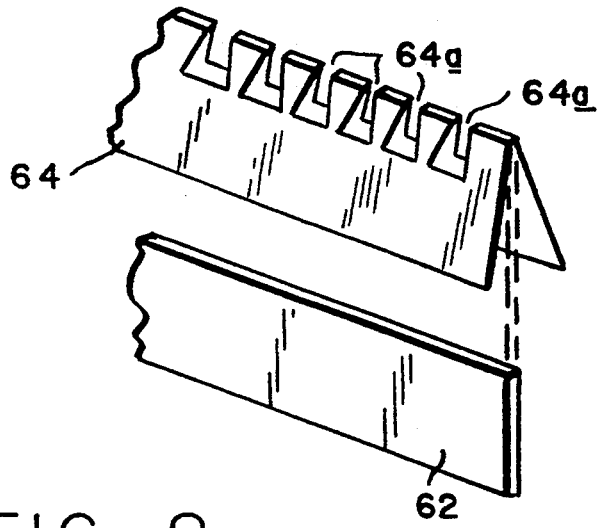
FIG. 8 is an analytical view showing an example of a recording paper separator used in the device.

FIG. 8 shows another example of a wrapped discharging material 62, characterized in that the discharging material 62 is covered with a high resistant film 64 having windows **64*a* spaced at intervals through which the discharging material is exposed. The discharging material 62** is retained by the retainer in this state.

Figure 5:
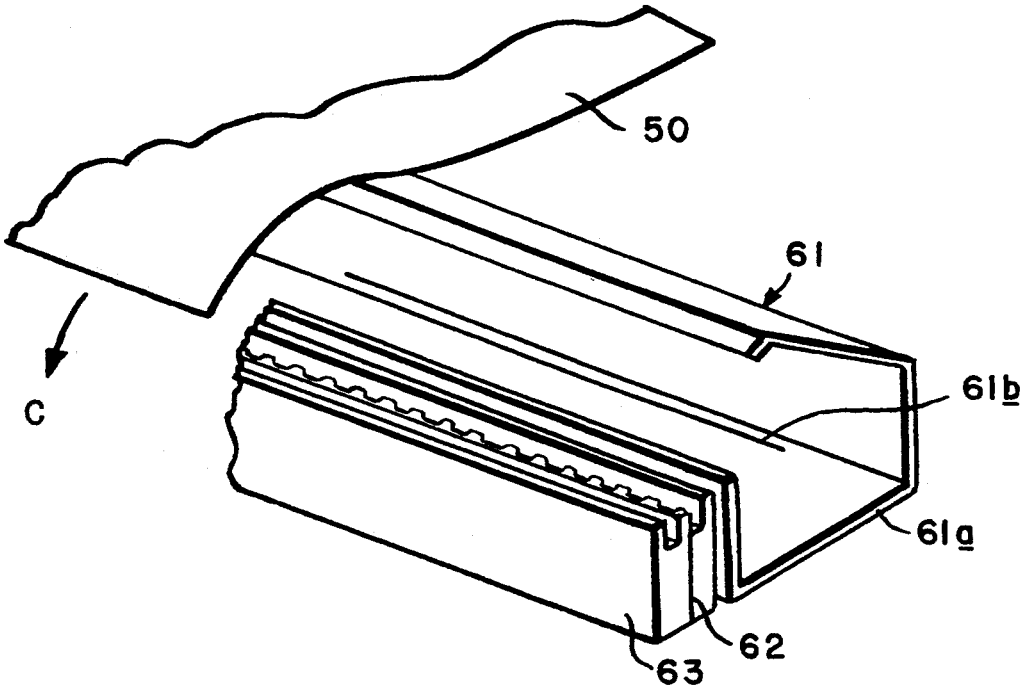
FIG. 5 is a perspective view showing a third example of the device.
Figure 9:
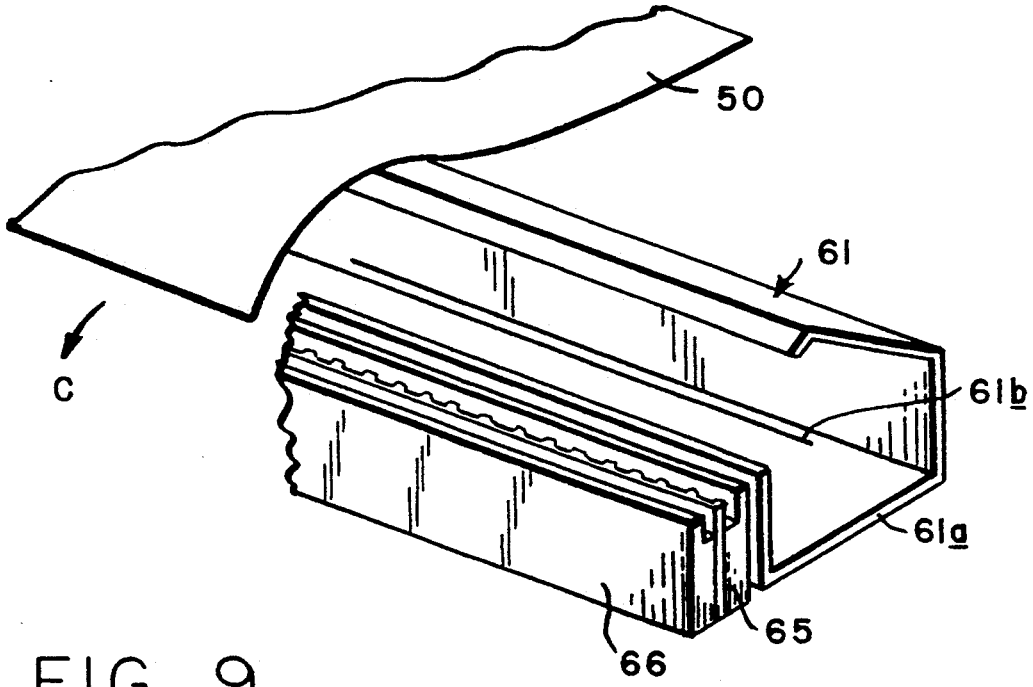
FIG. 9 is a perspective view showing a fourth example of the device.
Figure 10:
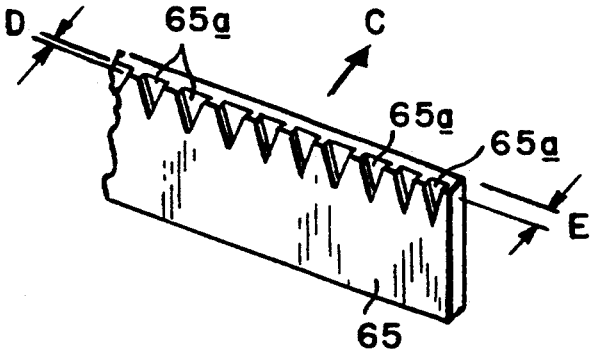
FIG. 10 is a perspective view showing a main portion of the device of FIG. 9.

Referring to FIGS. 9 and 10, in which like reference numerals designate like elements and components to those in FIG. 5, the recording separating discharging material 65 is made of a conductive thin plate, such as a stainless plate having a thickness of 0.05 mm to 0.2 mm. The top edge of the discharging material 65 is projected in the groove of a retainer 66. As shown in FIG. 10, the discharging material 65 is provided with a plurality of recesses **65*a* on the upstream side of the discharging material 65. Each recess 65*a* is triangular with its apex downward, and a portion between one recess and the next is projected in the opposite direction to that which the recording paper 50** is fed.

Each recess **65*a*** is formed by half-etching so that the depth D and the thickness E thereof have the following relationship:

$$0.1.E \leqq D \leqq 0.9.E$$

Instead of the half-etching process, a half-punching can be done by a press so as to make the recesses **65*a***.

The thickness E of the discharging material 65 is set to about 0.05 mm to 0.2 mm, and a thinner discharging material 65 enhances the discharging performance. An electric current from the charging wire **61*b* of the transfer charger 61 flows through the projecting portions between the recesses 65*a* via the recording paper 50. The discharging material 65** is also protected against deformation and breakage due to external force accidentally applied thereto.

Referring to FIGS. 9 and 10, experimental results will be shown to show the discharging material 65, wherein the photosensitive drum has a diameter of 30 mm:

Material: SUS304-CSP

Thickness (t): 0.1 mm

Steps between the recess 65a and other portion: approximately 0.05 mm

Process: etching

Applied voltage: about 3.5 kV

Discharging current: about 65μ

Figure 11:
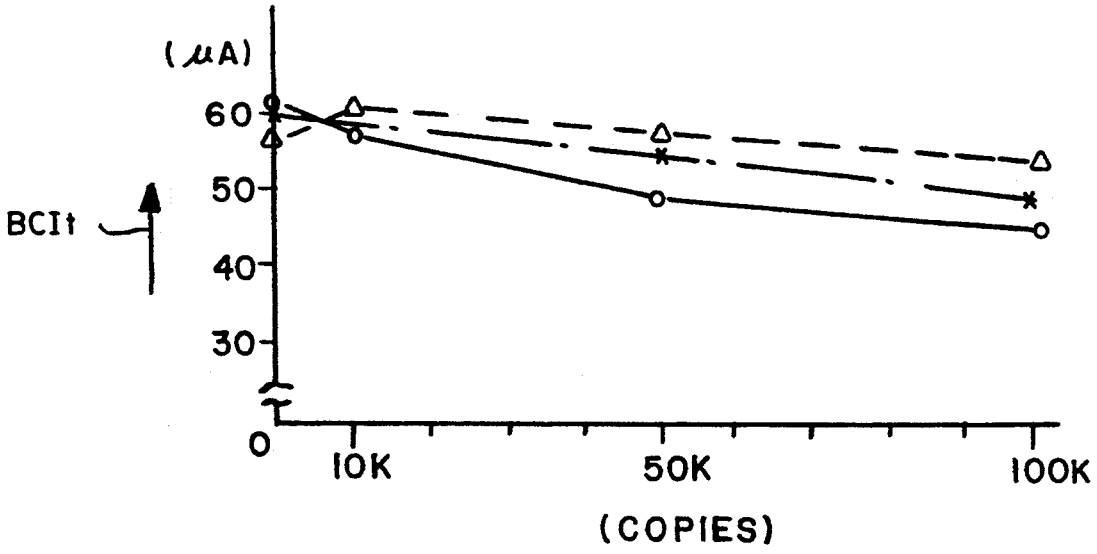
FIG. 11 is a graph showing changes in the discharging currents depending upon the recording paper dischargers.
Figure 12:
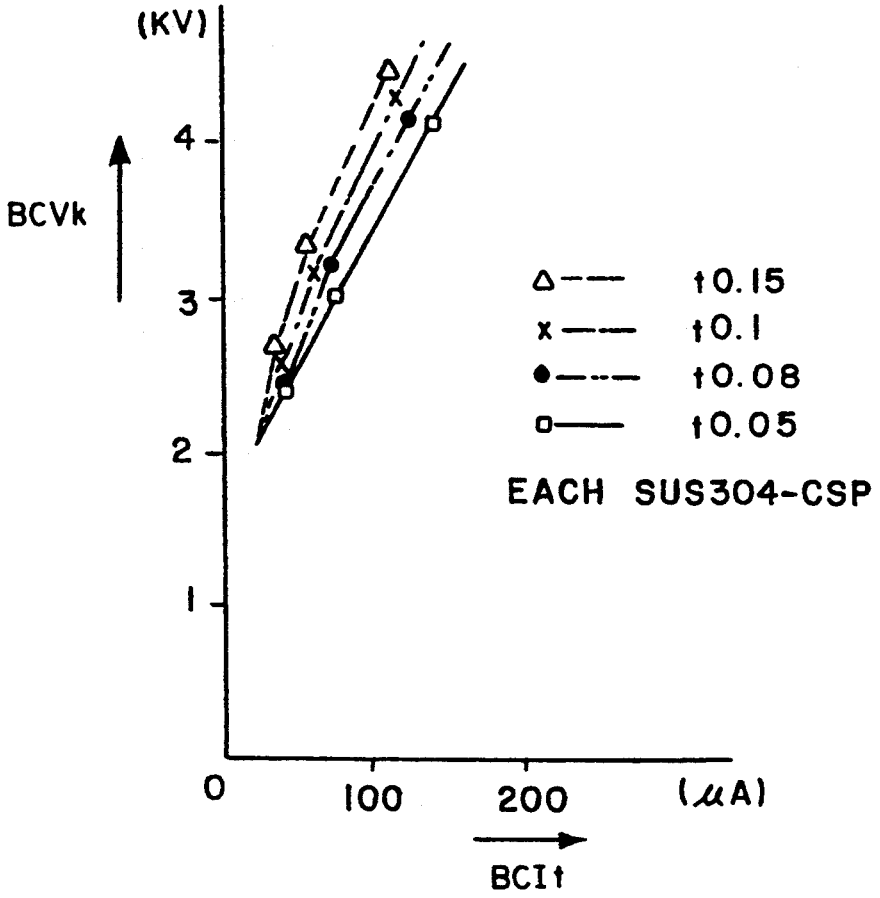
FIG. 12 is a graph showing the relationship between the applied voltage and the discharging current when the thicknesses of the recording paper discharger of SUS304-CSP are changed.

These data were obtained from the test shown in FIGS. 11 and 12. The etching process was adopted because of easiness.

FIG. 11 is a graph showing variations in the discharging current ($BCI_t$) in accordance with changes in the kinds of material used for the discharging material 65. The ○ means aluminum, X means stainless steel, and Δ means phosphor bronze.

As is evident from the graph, at the initial stage the $BCI_t$ has no substantial difference but as the number of copies increases, the phosphor bronze has less changes in the $BCI_t$ than the aluminum and stainless steel. From this point of view, the phosphor bronze is best but when cost and workability are taken into account, the stainless steel is preferable.

Referring to FIG. 12, which is a graph showing the relationship between the applied voltage ($BCV_k$) and the $BCI_t$ when the thickness t of the materials is changed, wherein Δ means that t is 0.15, X means that t is 0.1, • means that t is 0.08, and □ means that t is 0.05. The step was ½ t thick.

As is evident from the graph, as the thickness t of the discharging material 65 becomes smaller, the $BCI_t$ can be larger with the same $BCV_k$, thereby enhancing the discharging performance. From this point of view, when the thickness t is 0.05, the best result is attained. However, when cost, workability and handling easiness are taken into account, the thickness t of 0.1 mm is preferable.

Figure 13:
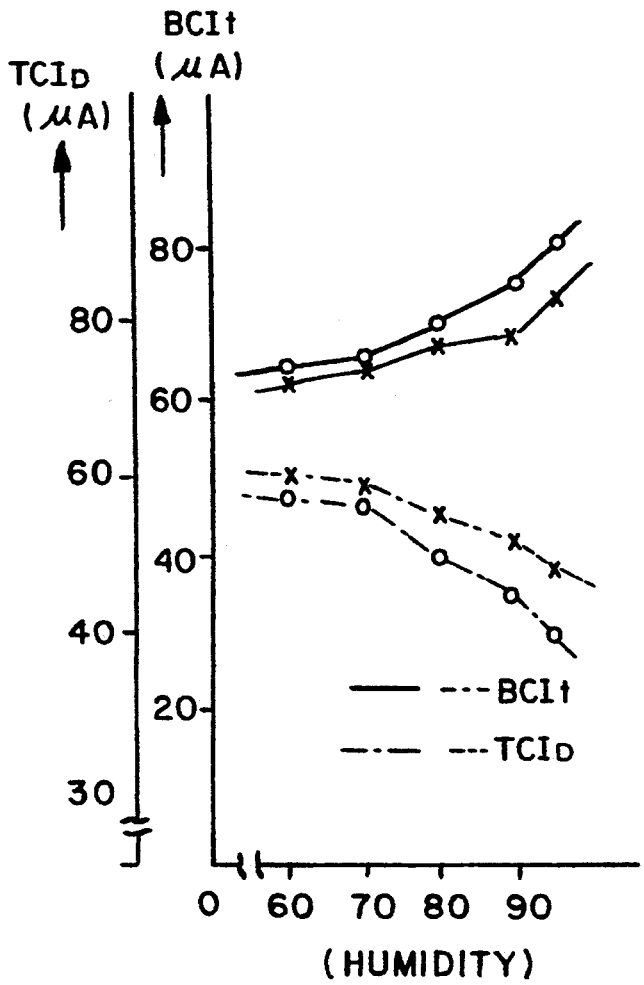
FIG. 13 is a graph showing the relationship among the discharging current, the transfer current and humidity in the climatic circumstances of high temperature and high humidity.
Figure 14:
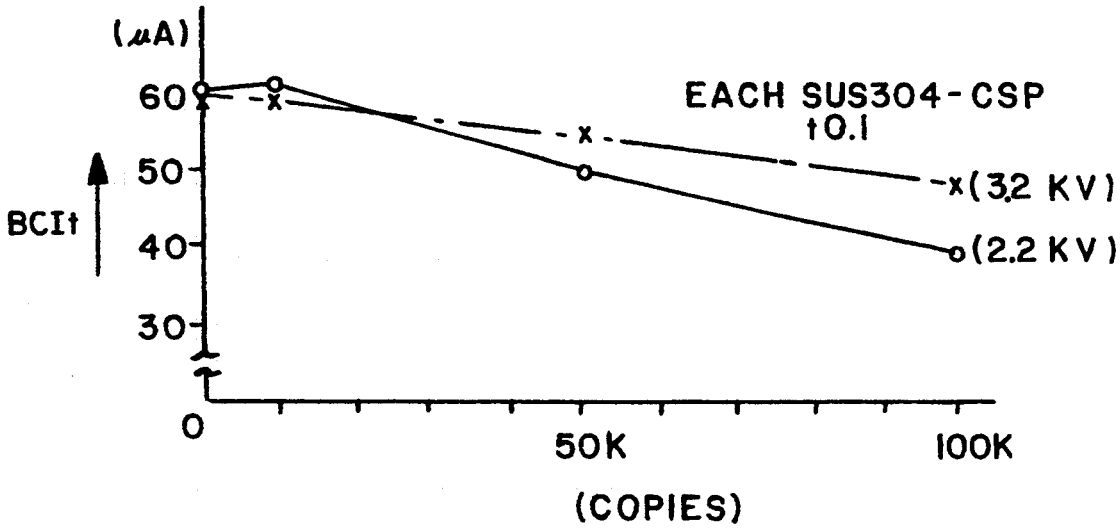
FIG. 14 is a graph showing the results of life tests of the recording paper discharger and the saw-toothed discharger.
Figure 15:
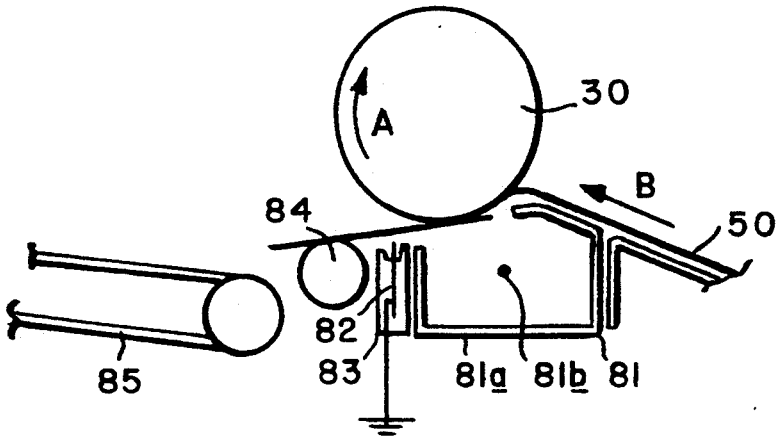
FIG. 15 is a cross-sectional view showing a prior art recording paper separating device.

Referring to FIGS. 13 and 14, the differences in effects will be described by comparison between the discharging material 65 of the present invention and a known saw-toothed discharging material. FIG. 13 is a graph showing the relationship between each of $BCI_t$ and $TCI_D$, and humidity at high temperature and at high humidity, wherein the full line means $BCI_t$ and $TCI_D$, the X means the $BCI_t$ and $TCI_D$. As is evident from the graph, the saw-toothed discharging material is more disadvantageous in that the $TCI_D$ radically drops with increases in the $BCI_t$ at high temperature and humidity than the discharging material of the invention. This means that the known saw-toothed discharging material is inferior in the transferring performance to the discharging material of the present invention.

Referring to FIG. 14, which is a graph showing the comparison in life between the discharging material 65 and the known saw-toothed discharging material, wherein the ○ means a saw-toothed discharging material and the X means the discharging material 65. The initial $BCI_t$ was set to about 60 μA.

As is evident from the graph, in order to obtain the same $BCI_t$, the known saw-toothed discharging material requires about 2.2 kV, whereas the discharging material 65 requires 3.2 kV. This means that an electric field is more intensified in the saw-toothed discharging material than the discharging material 65, but the intensified electric field tends to deteriorate the saw-toothed edge more quickly, thereby resulting in the shortened life. The discharging material 65 of the present invention can withstand a relatively long period of use.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A recording paper separating device for use in an electrophotographic apparatus, comprising:

a transfer charger for transferring a toner image from a photosensitive means onto a recording paper by discharge effected by a charging wire accommodated in a shield casing, a bias-loaded recording paper discharging means, a power source, and a control means for mainlining a current supplied from the power source to the charging wire constant except for current flowing through the recording paper discharging means, wherein the discharging means includes a conductive thin plate extending transverse to a direction in which the recording paper is fed, and said conductive thin plate having a straight edge adjacent to the recording paper being fed, the straight edge being covered with an electrically resisting material that is provided with openings spaced at intervals to that the discharging means is exposed through the openings.

2. A recording paper separating device for use in an electrophotographic apparatus, comprising:

a transfer charger for transferring a toner image from a photosensitive means onto a recording paper by discharge effected by a charging wire accommodated in a shield casing, a bias-loaded recording paper discharging means, a power source, and a control means for mainlining a current supplied form the power source to the charging wired constant except for current flowing through the recording paper discharging means, wherein the discharging means includes a conductive thin plate extending transverse to a direction in which the recording paper is fed, and is provided with a plurality of recesses in the upstream side of the thin plate relative to the paper feeding direction, the recesses being spaced at intervals along an edge of the thin plate that is adjacent to the recording paper and having a depth in the paper feeding direction of less than the thickness of the thin plate.

3. A recording paper separating device according to claim 1, wherein the thickness of the thin plate is between 0.05 and 0.2 millimeters.

4. A recording paper separating device according to claim 1, wherein the openings are in the shape of trapezoids.

5. A recording paper separating device according to claim 2, wherein the depth D of the recesses and the thickness E of the thin plate satisfy the equation:

$$0.1(E)<D<0.9(E)$$

6. A recording paper separating device according to claim 2, wherein the thickness of the thin plate is between 0.05 and 0.2 millimeters.

7. A recording paper separating device according to claim 2, wherein the thin plate is made of phosphor bronze.

8. A recording paper separating device according to claim 2, wherein the thin plate is made of stainless steel.

9. A recording paper separating device according to claim 2, wherein the recesses are in the shape of triangles with the apexes pointed away from the recording paper.

* * * * *

UNITED STATES PATENT AND TRADEMARK OFFICE

CERTIFICATE OF CORRECTION

PATENT NO. : 5,339,144

DATED : August 16, 1994

INVENTOR(S) : Nakai et al.

It is certified that error appears in the above-identified patent and that said Letters Patent is hereby corrected as shown below:

At Column 8, lines 19 and 41, please change "mainlining" to —maintaining—.

Signed and Sealed this

Twenty-second Day of November, 1994

*Attest:*

*Attesting Officer*

Bruce Lehman

BRUCE LEHMAN

*Commissioner of Patents and Trademarks*

UNITED STATES PATENT AND TRADEMARK OFFICE

CERTIFICATE OF CORRECTION

PATENT NO. : 5,339,144

DATED : August 16, 1994

INVENTOR(S) : Nakai et al.

Figure 16:
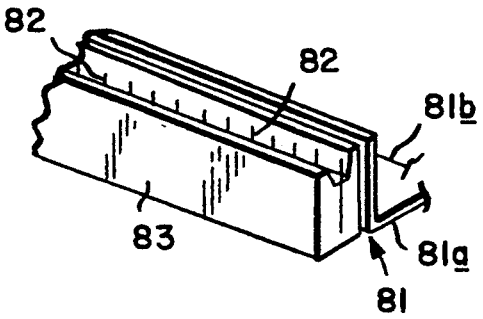

It is certified that error appears in the above-identified patent and that said Letters Patent is hereby corrected as shown below:

At Column 3, line 44, please change "FIG. 6" to —FIG. 16—.

At Column 4, line 64, please change "$Y_{BC}$" to —$I_{BC}$—.

Signed and Sealed this

Fourteenth Day of February, 1995

Bruce Lehman

*Attest:*

BRUCE LEHMAN

*Attesting Officer*

*Commissioner of Patents and Trademarks*